United States Patent [19]

Neuroth

[11] 4,453,035

[45] Jun. 5, 1984

[54] OIL WELL CABLE

[75] Inventor: David H. Neuroth, Bethany, Conn.

[73] Assignee: Harvey Hubbell Incorporated, Orange, Conn.

[21] Appl. No.: 429,530

[22] Filed: Sep. 30, 1982

[51] Int. Cl.[3] ..... H01B 7/18

[52] U.S. Cl. ..... 174/103; 174/102 SP; 174/106 R; 174/109; 174/117 F

[58] Field of Search ..... 174/15 C, 102 SP, 103, 174/106 R, 108, 109, 117 F, 47

[56] References Cited

U.S. PATENT DOCUMENTS

| | | | |
|---|---|---|---|
| 1,740,076 | 12/1929 | Delon | 174/103 |
| 1,927,845 | 9/1933 | Pheazey | 174/106 R X |
| 2,165,738 | 7/1939 | Van Hoffen | 174/105 R |
| 2,391,037 | 12/1945 | Shafer | 174/102 SP |
| 2,483,301 | 9/1949 | Roberds | 174/15 C |
| 2,544,233 | 3/1951 | Kennedy | 174/117 R |
| 2,897,253 | 7/1959 | Davey et al. | 174/109 |
| 3,351,706 | 11/1967 | Gnerre et al. | 174/105 R |
| 3,988,526 | 10/1976 | Rasguin et al. | 174/15 C |
| 4,196,307 | 4/1980 | Moore et al. | 174/47 |
| 4,277,642 | 7/1981 | Piper | 174/117 R |
| 4,282,398 | 8/1981 | Solomon | 174/106 R |
| 4,374,530 | 2/1983 | Walling | 174/47 X |

FOREIGN PATENT DOCUMENTS

| | | | |
|---|---|---|---|
| 1020074 | 11/1957 | Fed. Rep. of Germany | 174/117 R |
| 834995 | 12/1938 | France . | |
| 335147 | 9/1930 | United Kingdom . | |
| 437525 | 5/1935 | United Kingdom . | |
| 699558 | 1/1953 | United Kingdom . | |
| 890188 | 2/1960 | United Kingdom . | |
| 976040 | 11/1963 | United Kingdom . | |
| 1242494 | 8/1971 | United Kingdom . | |
| 1250823 | 10/1971 | United Kingdom | 174/136 |
| 1387180 | 3/1975 | United Kingdom . | |
| 1405304 | 4/1975 | United Kingdom . | |
| 2069746 | 8/1981 | United Kingdom . | |
| 367814 | 2/1982 | United Kingdom . | |

*Primary Examiner*—J. V. Truhe
*Assistant Examiner*—Morris H. Nimmo
*Attorney, Agent, or Firm*—Jerry M. Presson

[57] ABSTRACT

Disclosed is an electrical cable embodying a plurality of individually, electrically insulated electrical conductors for use in adverse environments, such as oil wells. The cable comprises an elongated strut of rectangular cross-section interposed between two of the conductors and formed of a plurality of bendable sections of rigid cross-section for protecting the insulation on the conductors from external disruptive forces. The strut may be used with a channel member that protects the insulation from both internal and external disruption resulting from usage in the adverse environment.

15 Claims, 8 Drawing Figures

OIL WELL CABLE

This invention relates to an electrical cable and more particularly, to a cable for use in an extremely adverse environment, such as those encountered in oil wells.

BACKGROUND OF THE INVENTION

Electrical cables which are used in oil wells must be able to survive and perform satisfactorily under extremely adverse conditions of heat and mechanical stress. Ambient temperatures in wells are often high and the $I^2R$ losses in the cable itself add to the ambient heat. The service life of a cable is known to be inversely related to the temperature at which it operates. Thus, it is important to be able to remove heat from the cable while it is in its operating environment.

Cables are subjected to mechanical stresses in several ways. It is common practice to attach cables to oil pump pipes to be lowered into a well using bands which can, and do, crush the cables, seriously degrading the effectiveness of the cable insulation and strength. The cables are also subjected to axial tension and lateral impact during use.

It is therefore conventional to provide such cables with external metal armor and to enclose the individual conductors within layers of materials chosen to enhance the strength characteristics of the cable and ensure against insulation destruction, but such measures are sometimes not adequate to provide the necessary protection.

An additional problem arises as a result of down-hole pressures, which can be in the hundreds or thousands of pounds per square inch, to which the cables are subjected. Typically, the insulation surrounding the conductors in a cable contains micropores into which gas is forced at these high pressures over a period of time. Then, when the cable is rather quickly extracted from the wall, there is not sufficient time for the intrapore pressure to bleed off. As a result, the insulation tends to expand like a balloon and can rupture, rendering the cable useless thereafter.

In U.S. Pat. No. 4,409,431 in which the assignee is the same as the assignee in the instant invention, there is described a cable structure which is particularly suitable for use in such extremely adverse environments. The structure protects the cable against compressive forces and provides for the dissipation of heat from the cable which is an important feature in high temperature operating environments, for reasons discussed therein, and resistance to decompression expansion of the insulation.

As described in said copending application Ser. No. 291,125, the cable protective structure includes one or more elongated force-resisting members which conform to, and extend parallel and adjacent an insulated conductor comprising the cable. These members are rigid in cross-section to resist compressive forces which would otherwise be borne by the cable conductors. For applications requiring the cable to undergo long-radius bends in service, the elongated support may be formed with a row of spaced-apart slots which extend perpendicularly from the one edge of the member into its body to reduce the cross-sectional rigidity of the member in the slotted areas so as to provide flexibility in the support to large-radius bending about its longitudinal axis.

As described in my copending patent application Ser. No. 390,308 filed June 21, 1982 and assigned to the same assignee as the present invention, for certain service applications, it may be preferred that the electrical insulating sheath on the cable conductor not be in direct contact with the slot openings. This is because the slot openings in the support member may allow highly corrosive materials to gain access to the jacket composition by flowing inwardly through the slots. In addition, the corners formed by the slots may cut into or abrade the underlying cable jacket upon repeated bending of the cable.

The cable protective structure of said copending application Ser. No. 390,308 is made of a composite structure which utilizes an elongated force-resisting member of good thermal conductivity positioned adjacent the insulating conductor sheath. This member comprises a channel member having two substantially parallel elements or legs cantilevered from a transverse or vertical leg and which are slotted laterally to impart the requisite long-radius bending in the plane of the transverse leg. The parallel legs may extend in the same direction from the transverse leg toward an adjacent conductor in which case the channel has a U-cross sectional shape. A smooth, bendable liner may be mounted between the three legs of the channel and the insulation sheath of the adjacent conductor to bridge the slots in the member and thereby protect adjacent insulation from abrasion by the slot edges during bending of the member.

Certain service applications may require even greater resistance to repetitive impacts and high compressive forces than can be withstood by the force-resisting channel member disclosed in my copending application Ser. No. 390,308. Such extreme forces may cause inward bending of one or both of the two parallel channel legs because these forces are typically applied in planes substantially perpendicular to the plane of these legs and eccentric to the planes of attachment between these legs and the central supporting leg of the channel.

For certain applications of flat cable, it may be desirable to increase the thickness of insulation on one or more cable conductors with minimum increase in the cross-sectional dimensions of the cable. For such applications, it would be desirable if the cross-sectional dimensions of the channels could be minimized without adversely affecting the compression and impact resistance of the cable. Other applications for flat cable may require that, in addition to electrical conductors, the cable incorporate one or more hollow conduits for conveying fluids or instrumentation down the cable to, for example, a certain location in a bore hole and provide compression and impact protection to such conduits.

OBJECTS OF THE INVENTION

An object of this invention is to provide a cable incorporating a protective structure which is a composite of a first force-resistant member formed of a plurality of interconnected sections of rigid cross-section for protecting an underlying conductor from compressive forces and a bendable second member of at least equal rigidity for supplementing the protection provided by the first member against severe compression and impact forces.

Another object of this invention is to provide a flat cable incorporating an elongated, bendable protective structure which is comprised of a composite of two parts; a first bendable channel member of rigid cross-section for protecting insulated cable conductors against perpendicularly applied compressive forces and a second channel member of substantially greater rigidity which is bendable with the first channel for supplementing the conductor protection provided by the first channel against severe impacts.

Yet another object is to provide a cable in accordance with the foregoing objects, for use in extremely adverse environments, which is thermally conductive to dissipate heat and is resistant to severe impacts and compressive forces.

Still another object of this invention is to provide a cable structure incorporating an elongated, protective member of rigid, rectangular cross-section which extends between adjacent insulated conductors substantially the thickness of the insulation for protecting the conductor insulation from external disruptive forces.

DETAILED DESCRIPTION OF THE INVENTION

Figure 1:
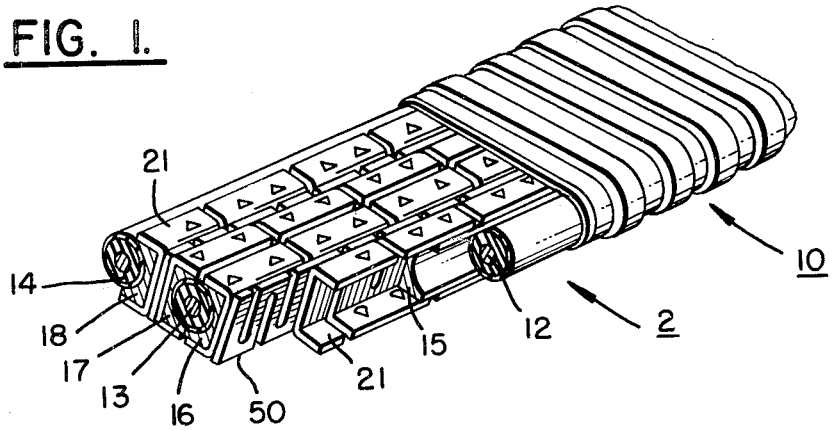
FIG. 1 is a partial perspective sectional view of a length of cable constructed in accordance with this invention, illustrating an end portion with its outer protective jacket removed.

FIG. 1 illustrates one embodiment of a cable 10 constructed in accordance with the present invention which is particularly suitable for use in extremely adverse environments such as oil well applications wherein the cable is subject to very high temperatures and pressures, and to very severe compressive forces and impacts from, for example, hammers, or other tools.

The cable 10 illustrated therein includes an exterior metal protective jacket 11 which surrounds and encloses a plurality of individually insulated conductors 12, 13 and 14. For downhole applications, the conductors are arranged so that the central axes of the conductors lie parallel and in essentially the same plane providing the cable with a preferred flat shape.

The jacket 11 is typically formed of a preshaped metal strip wrapped around the cable structure in helical fashion. The juxtaposed conductors are of considerable length, as needed, it being understood that only a very short length of the cable is illustrated in FIG. 1. Interposed between the insulated conductors are four force-resisting members 15, 16, 17 and 18, each of these members being elongated and extending parallel to the conductors.

The members 15, 16, 17 and 18 are made of a material which is substantially rigid in cross-section and which is selected to have good thermal conductivity properties; specifically, a thermal conductivity which is at least greater than the thermal conductivity of the conductor insulation. Fiber-filled carbon compositions are suitable for this purpose, and also exhibit good compression resistance. Metals such as steel and aluminum are also suitable for this purpose, as are metal-filled curable polymeric materials.

Figure 2:
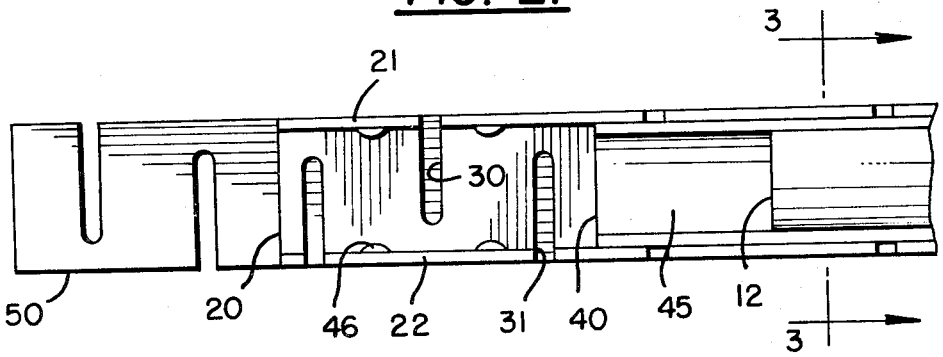
FIG. 2 is a side elevational view of the one end portion of the cable of FIG. 1 as viewed in the direction of arrow 2 of FIG. 1.

Each channel 20 for the members is essentially of U cross-sectional shape formed by a pair of elements or legs 21 and 22, respectively, which are substantially flat, parallel and horizontal as viewed in FIG. 2 so that they conform to the respective upper and lower flat surfaces of the metallic jacket 11. The lateral legs of the members 15, 16, 17 and 18 are joined by a rigid, vertical element or leg 23 which is slightly longer than the overall diameter of the conductor and its covering layer or layers of insulation. As will be seen, the cross-sectional shape of each such member is that of a substantially U-shaped channel with the legs 21 and 22 extending approximately to a vertical plane passing through the center of the adjacent conductor which faces the open U part of the channel. Hence, the legs 21 and 22 extend from the flat joining leg 23 to each side of this conductor a distance which is about equal to the maximum radius of the conductor plus its insulation covering. Crushing forces applied to the cable jacket 11, especially in directions perpendicular to the longitudinal axis of the cable 10, will be resisted by the channels 20 which are rigid in cross-section and damage to the conductor insulation by such forces will thereby be resisted. Thus, when the cable is attached to an element such as a well pipe or oil recovery motor by bands or straps, a situation which often causes crushing of a cable, the band engages the outside of jacket 11 and the rigid support members 15, 16, 17 and 18 prevent damage from being done to the underlying insulation.

The channels 20 for the members 15, 16, 17 and 18 should also have a degree of bidirectional flexibility and resilience which can permit the cable to undergo long-radius bends as necessary when installing the cable in a service location. This is provided by a first row of slots 30 extending inwardly through each of the channel legs 21 and perpendicularly through the joining leg 23 and terminating approximately at the bend where the leg 23 joins the opposite leg 22. The slots 30 are substantially uniformly spaced apart in the longitudinal direction of the channel and thereby divide the channel 20 into a succession of individual, flexibly interconnected channel segments. Longitudinally and alternately spaced between slots 30 is a second and opposite row of slots 31 which extend perpendicularly into the body of each channel 20 from leg 22 to the bend where the leg 21 meets the leg 23. Slots 31 are also substantially uniformly spaced apart in the longitudinal direction, and lie approximately midway between slots 30. Thus, the slots 30 and 31 extend inwardly alternately from the legs 21 and 22, respectively, and impart greater bidirectional flexibility to the channels 20 in the major plane of cable bending; that is, in a plane perpendicular to the plane passing through the centers of the juxtaposed cable conductors 12, 13 and 14.

Figure 3:
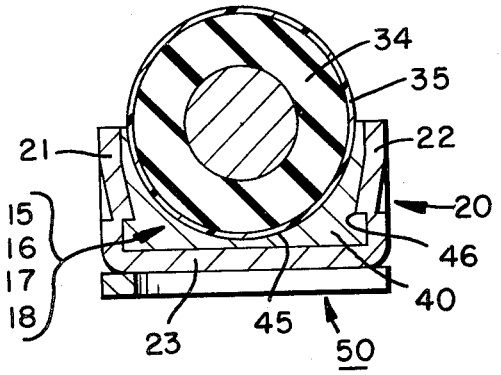
FIG. 3 is an end sectional view of a composite channel member mounted on an insulated cable conductor taken along section lines 3—3 of FIG. 2 to which supplementary support is provided in accordance with this invention.

Each of the conductors 12, 13 and 14, may be a stranded or solid metallic electrical conductor, and as best seen in FIGS. 1 and 3, each conductor is covered or sheathed by one or more concentric layers of suitable electrical insulation. Two of such insulating layers are shown and designated 34 and 35, respectively, in FIG. 3. The layers 34 and 35 are typically composed of plastic or rubber components which are relatively soft and therefore may have the surfaces cut or abraded by rubbing or other direct contact with harder or more rigid surfaces such as used in the force-resisting channels 20. Any such cutting or abrasion of the conductor insulation may seriously degrade its coating and insulating characteristics.

The slots 30 and 31 cut into the channels 20, in particular, may result in sharp edges and corners being formed on the inside of the channels 20 which might abrade the softer insulating layer 35 placed in immediate contact with a channel 20, especially if the channel is formed from steel or aluminum stock.

To prevent such abrasion, an elongated liner is inserted into the U formed by channel 20. The liners, one of which is designated by the numeral 40, have substantially flat, opposite surfaces abutting and coextensive with the inner surfaces of legs 21 and 23. A semi-circular edge surface 45 is formed on the liner to conform to the cylindrical, outermost insulating layer 35 of underlying insulation. Each liner 40 is made sufficiently continuous to bridge the inner corners and edges formed by the slots 30 and 31, thereby spacing these edges from direct contact with the insulation on the underlying conductor core.

The protective liners 40 are preferably somewhat flexible so as to bend through arcs simultaneously with its overlying channel 20 in directions substantially perpendicular to the major bending plane or longitudinal axis of the cable 10. For oil well applications, the liners 40 are preferably composed of a material having good thermal conductivity to dissipate the heat applied to the cable 10 in such environments. The liner material should be relatively smooth to slide on the outermost insulating jacket 35, especially during bending of the latter. A suitable metallic material for the liners is lead, which has a smooth surface for facilitating sliding upon resilient layers of insulation and yet provides good thermal conductivity. Other suitable metallic or nonmetallic materials may also be used for the liners. The liners also afford a measure of protection to the insulation of the conductors against contact with, and possible attack by, insulation-degrading and corrosive chemicals. The central cable conductor 13, FIG. 1, is especially protected by oppositely facing, and the nearly adjoining edges of the concave surfaces 45 of the two liners which are respectively embodied in a pair of oppositely facing support members 16 and 17, FIG. 1.

By forming each of the support members 15, 16, 17 and 18 as a composite of a flat channel 20 and a liner component 40 which can be inserted into the channel 20, the manufacture of the force-resisting members is facilitated. As is the case with the channels 20, the individual liners 40 can be manufactured by cutting the requisite lengths from a longer, continuous length of suitably sized and shaped strip of liner material.

The liners 40 may be fixedly mounted in their respective channels 20 by merely dimpling, semi-piercing or coining inwardly small surface areas on the opposite legs 21 and 22 of the channels 20 to form inwardly projecting protuberances or barbs 46. The opposing protuberances 46 cooperate to grip therebetween the upper and lower surfaces of the liners 40 forcibly pressed into associated channel members with their concave surfaces 45 facing the same direction as that of the interior of the channel U.

The channel members and liners described hereinabove are disclosed and claimed in my copending application Ser. No. 390,308 and work well under most of the conditions encountered in oil wells. However, there may be situations where the cable is subject to impact and crushing forces which are extreme enough to cause substantial inward deflection of the channel members. In such cases, the outward ends of the parallel legs 21 and/or 22 of the channel members may be bent inwardly toward one another causing the joining leg 23 to bend about its major plane, far enough to allow either or both of the legs 21 and 22 to crush and possibly even penetrate the underlying liner and conductor insulative sheath.

In accordance with the present invention, a supplementary compression and impact resisting member is interposed between pairs of adjacent legs 23 and oriented perpendicular to the plane of the cable 10. This member comprises a strut element 50 of rectangular cross-sectional shape and is mounted on its edge to reinforce the crush and impact resistance of the adjacent U channel members 20. The struts 50 are composed of materials which have high second moments of inertia or resistance to bending and good thermal conductivity to expedite the transfer of heat from the cables.

The struts 50 have a thickness which may vary substantially depending upon such factors as the maximum permissible cable width dimensions and the desired supplementary cable impact and crush resistance which is to be afforded the cable. For a given length of cable, the length of each strut is typically made substantially equal to that of the U channel member 20 located on an adjacent side of the strut. The strut height dimension is at least equal to that of the adjacent and parallel leg 23 of each channel so that the struts receive and absorb the compression and impact forces which would otherwise be absorbed primarily by the channel members.

As mentioned hereinabove, the struts are preferably composed of a material which also has a good thermal conductivity in order to supplement the transfer and dissipation of heat energy in the cable in high temperature environments. Good thermal conductivity as well as high compression and impact resistance is obtainable when the struts are fabricated from metals such as steel and aluminum.

Inasmuch as the cable 10 should be flexible enough to undergo bidirectional, long-radius bends simultaneously with and to the same extent as the U channel members 20, the struts 50 may be slotted in the same fashion as the legs 21 and 22 of the U channel members 20; that is, with longitudinally, alternately spaced slots 52 and 53, extending into the edges 54 and 55, respectively, of the struts 50. The slots 52 and 53 extend far enough inwardly of the body of each strut 50 to provide the requisite flexibility to bending. Typically, the open-ended slots 52 and 53 extend past the strut centerlines and bottom close to the respective opposite edges 55 and 54. With the struts 50 interposed between the vertical legs 23 of oppositely facing U channels, the slots 52 may be displaced or offset longitudinally from the slots in the U channel, as shown in FIG. 2, to prevent the edges defining one set of slots in the U channels from engaging and interfering with the adjacent set of slots in the struts, especially in instances where the cable 10 is twisted about its major plane during usage.

Figure 4:
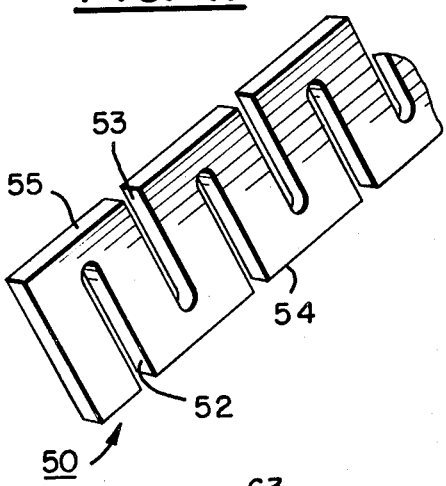
FIG. 4 is a partial perspective view of one end of a supplementary compression and impact-resisting strut member constructed in accordance with the instant invention.

The slots 52 and 53 may extend perpendicularly with respect to the longitudinal axis of the strut, as shown in FIG. 4, or the slots may be inclined at an angle less than a right angle to provide the strut with a capability for greater absorption of impacts applied perpendicularly against the flat strut edges 54 or 55.

Figure 5:
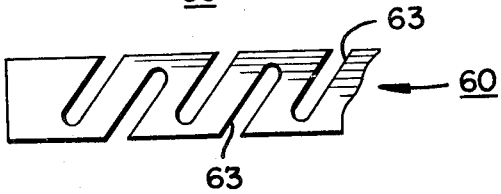
FIG. 5 is a side elevational view of another embodiment of an impact and force-resisting strut member constructed in accordance wih this invention.

In the embodiment of FIG. 5, strut 60 includes slots 62 and 63 with opposite open edges which are inclined at about 45 degrees with respect to the longitudinal axis of the strut 60. By inclining the slots in this manner, the edgewise resilience characteristics of the strut 60 is increased so that the strut 60 more readily collapses in response to edge impacts. So long as the yield point of the strut material is not exceeded, the strut 60 will at least partially return to its initial configuration, as illustrated in FIG. 5.

Figure 6:
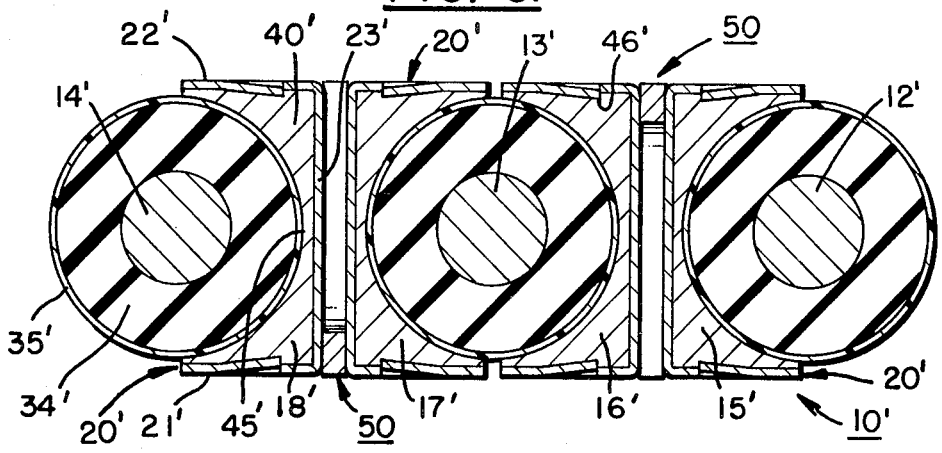
FIG. 6 is an end sectional view of another embodiment of a cable constructed in accordance with this invention with the exterior jacket removed.

The struts 50 and 60 make it possible for the cable 10 to increase the thickness of insulation on the individual conductors with minimum increase in the overall cross-sectional dimensions of the cable. This is because with the struts utilized by the cable as the principal compression and impact-resisting elements, the thickness of the legs 21, 22 and 23 of the channel members 20 can be minimized thereby increasing the area available within the U channels for accommodating more conductor insulation material. For example, and as illustrated in the embodiment of FIG. 6, wherein like parts in FIGS. 1–5 are distinguished by single prime designations (′), and assuming there is about the same amount of liner material in each liner 40′ as in the previous embodiment illustrated by FIG. 3, the thickness of the channel legs 21′, 22′ and 23′ of the members 20′ may be made less than one-half of that of the member 20 in such previous embodiment. This reduction in the cross-section area required of the members 20′ for the conductors 12′, 13′ and 14′ offers the advantage of allowing thicker layers 34′ and/or 35′ of insulation to be placed on each of the conductors 12′, 13′ and 14′ of the cable 10′. As will be evident, the inner edges 45′ of the liners 40′ would have a larger radius of curvature to account for the greater diameter of insulation on the conductor.

The exterior jacket or armor, the struts and the lead inserts as well as the vertical legs of the channel members all serve to protect the conductor insulation from damage caused by vertical crushing, horizontal or lateral (edge) impact and from damage resulting from decompression rupture. Thus, vertical legs 23 of the channel members greatly enhance crush resistance and in this case, the width of each of the vertical legs should be only about one-half that of the center struts 50. By reducing the thickness of the outer two channel members, proportionally more insulation can be enclosed by the thinner channel members without appreciably increasing the overall thickness of the cable. Advantageously, the extra thickness of insulation can serve to provide greater resistance to edge impacts. Also, during certain steps in the manufacturing process and particularly when the cable is being jacketed or armored, the outside insulation may be displaced longitudinally, radially or otherwise deformed. Accordingly, it is advantageous to provide an extra radius of insulation on the outside conductors so that a minimum layer of insulation will be insured.

As mentioned hereinabove, decompression expansion tends to occur when the insulation trys to blow-out due to the presence of compressed gases within it. The horizontal or longitudinal force components so generated are balanced in the design and no appreciable net displacement in the longitudinal sense occurs. However, outwardly directed force components tend to force the legs 21 and 22 of the channel member 20 outwardly and apart. Sufficiently high internal pressures could bend the channels open far enough to allow the cable insulation to edge flow around and between the channel legs 21 and 22. This tendency is greatest for the center conductor because the jacket corrugations may not press inwardly firmly against the legs 21 and 22 of these mutually opposing channel members enclosing that conductor.

Figure 7:
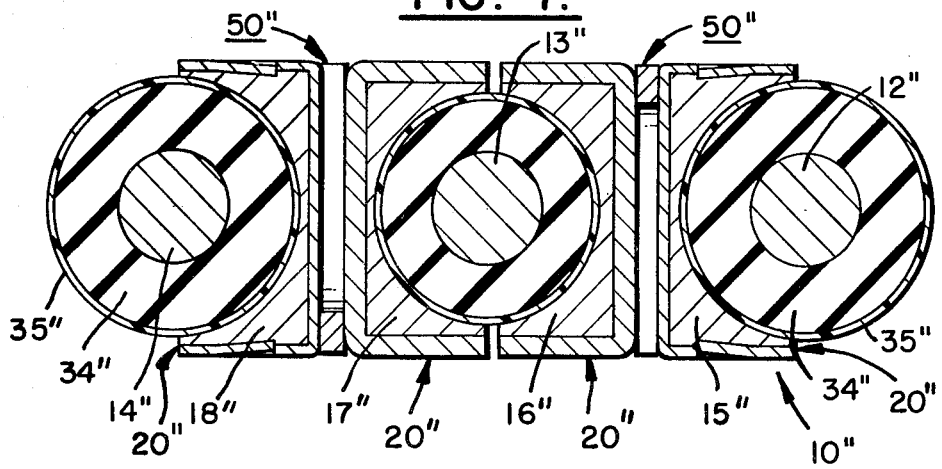
FIG. 7 is an end sectional view of yet another embodiment of a cable constructed in accordance with this invention with the exterior jacket removed.

However, the outside channel members receive appreciable support from the jacket because the jacket corrugations loop around the insulation on the outer conductors and the legs 21 and 22 of the channel members. This is why for some applications, the outside channels do not need to be as thick as the more centrally located channel members in order to withstand the same decompression forces. The embodiment of FIG. 7 illustrates a cable structure (with its exterior metal jacket removed) which provides good crush resistance, more insulation on the outside conductors to withstand edge flows and equal decompression strength, with no increase in cable thickness and a relatively small increase in width. In addition, this embodiment allows less metal to be used in the channel members increasing cable flexibility.

In FIG. 7, like parts in FIGS. 1–6 are referred to by the same numerals and distinguished by double prime (″) designations. In this embodiment, the two outer conductors 12″ and 14″ of the cable 10″ rely on the struts 50″ which are located on either side of and parallel to the central conductor 13″, primarily to resist impact and compression forces. The two outer channel members 20′ embracing the liners 15″ and 18″, respectively, are about one-half the thickness of the central channel members 20″ permitting considerably thicker layers 34″ and/or 35″ of insulation material to be applied to the two outer conductors 12″ and 14″ than that covering the central conductor 13″ without increasing the overall thickness of the cable.

Figure 8:
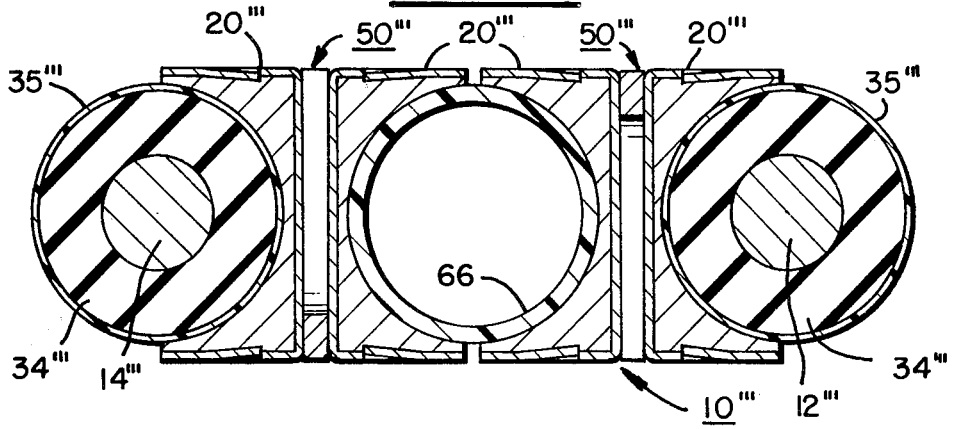
FIG. 8 is an end sectional view of still another embodiment of the cable of this invention with the exterior jacket removed depicting means for conveying fluids or instrumentation through the cable.

FIG. 8 illustrates another embodiment of this invention wherein the cable 10‴ of the instant invention also incorporates a hollow, flexible conduit of tube 66 of substantially circular cross-section disposed centrally in the cable 10‴. The tube 66 may be of substantially the same outer diameter as the outermost diameter of the insulation 35‴ on an adjacent one of the outer conductors 12‴ or 14‴ and serves to convey various liquids such as oil, hydraulic fluid and coolant within the cable structure.

The tube 66 may be made of thermo-plastic or other suitable material capable of undergoing long-radius bends with the conductors 12‴ and 14‴, and in addition to conveying fluids, may be used as a medium for enclosing various types of instruments and instrument wires such as thermal or pressure sensing devices within the cable interior at various locations along the length of the cable. The tube 66 may also be used to draw substances up through the cable interior. One or more exterior slots or orifices (not shown) that communicate with the interior of tube 66 may extend transversely through one or both sides of the cable 10‴ to provide one or more points for communication between the interior of the tube 66 and the exteriormost surface of the cable 10'''.

Protection of the tube 66 against deforming and penetrating impacts and compressive forces is provided by channel and strut structures designated 20''' and 50''', respectively, and described hereinabove.

As disclosed hereinabove, the various embodiments of cable constructed in accordance with the instant invention incorporates elongated strut members 50 and 50' of generally rectangular cross-section to protect an adjacent layer of electrical insulation from potentially disruptive external force components. Because these force-resisting members provide this protection, for some applications this permits the use of thinner armor on the exterior of the cable. For other applications where protection against expansion of the insulation by outwardly directed decompressive force components is not a requirement, the channel members 20, 20', 20'' and 20''' which serve to contain the insulation against expansion, may be eliminated from the cable construction leaving only the struts 50 or 50' as the insulation protective element.

While various advantageous embodiments have been chosen to illustrate the invention, it will be understood by those skilled in the art that various changes and modifications can be made therein without departing from the scope of the invention as defined in the appended claims.

What is claimed is:

1. An electrical cable comprising:

a plurality of elongated, electrical conductors having substantially parallel longitudinal axes, each of said conductors being electrically insulated from one another by an individual layer of insulation covering each conductor;

a jacket surrounding the insulated conductors;

a first elongated element within said jacket mounted intermediate the layers of insulation on said conductors and having a longitudinal axis and cross-section transverse to the axis thereof extending adjacent opposite portions of said jacket, said first element having a portion thereof surrounding a section of the insulation on one of said conductors for resisting outwardly directed force components applied to the insulation section;

a second elongated element within said jacket of substantially rectangular cross-sectional shape mounted adjacent said first element and having a longitudinal axis and a cross-section transverse to the longitudinal axis thereof, said cross-section extending adjacent opposite portions of said jacket in closer proximity to the jacket than is said section of insulation;

said first and second elements being rigid in transverse cross-section for resisting force components directed inwardly toward said section of insulation and being sufficiently flexible for long-radius bending in at least one plane.

2. An electrical cable comprising:

a plurality of elongated electrical conductors having substantially parallel, longitudinal axes, a layer of electrical insulation surrounding individual ones of said conductors for electrically insulating each of said conductors:

a first elongated member located intermediate the insulated conductors and having a first leg portion extending toward and adjacent the surface of the insulation of one of said conductors, and a second longitudinal leg portion supporting said first leg portion, said second leg portion being less compressible than the insulating layer on the adjacent one of the conductors for resisting internal and external insulation-disruptive forces; and a second elongated member having a longitudinal axis and a substantially rectangular cross-section transverse to said longitudinal axis, said second member being mounted in the cable substantially parallel to and adjacent said first member and extending beyond the layer of insulation on one of said conductors in the transverse plane, said cross-section being rigid in a transverse plane for resisting external disruptive forces applied to the cable.

3. The cable according to claim 2 wherein said first member has a third leg portion mounted thereon and extending substantially parallel to said first leg portion to a position adjacent another surface of the insulation.

4. The cable according to claim 3 wherein said first and third leg portions extend in the same direction from said second leg portion whereby said first member is of substantially U cross-sectional shape.

5. The cable according to claim 2 wherein said first and second members are each comprised of a plurality of flexibly, interconnected sections for long-radius bends in one plane which is substantially perpendicular to a plane containing said longitudinal axis.

6. The cable according to claim 5 wherein said flexibly interconnected sections of said first and second members are formed in part by a plurality of open-ended slots located in an edge portion of each of said members.

7. The cable according to claim 6 wherein the slots in said second member are inclined at substantially less than ninety degrees to the longitudinal axis thereof.

8. The cable according to claim 7 wherein certain of the slots extend alternately from opposite edge portions of said first and second members.

9. The cable according to claims 3 or 4 wherein said first and second members are of rigid cross-section.

10. The cable according to claim 2, wherein the thickness of said first leg portion of said first member is substantially less than the thickness of said second member.

11. The cable according to claim 3, wherein the thickness of said second and third leg portions of said first member is substantially less than the thickness of said second member.

12. The cable according to claim 2 wherein an elongated hollow member is positioned adjacent said second member.

13. The cable according to claim 4 wherein an elongated hollow member is positioned within the U of said first member.

14. The cable according to claim 2 wherein the electrical conductors have laterally spaced-apart axes substantially aligned in one plane.

15. An electrical cable comprising:

a plurality of elongated, electrical conductors having substantially parallel longitudinal axes, each of said conductors being electrically insulated from one another by a covering layer of insulation;

a jacket outwardly of and surrounding the insulated conductors;

an elongated member within said jacket having a longitudinal axis and a cross-section of substantially rectangular cross-sectional shape transverse to the longitudinal axis thereof, said member mounted intermediate the layers of insulation on said conductors with the cross-section thereof extending in a transverse plane more closely adjacent opposite portions of said jacket than the portions of insulation layers in the transverse plane;

said member having a rigidity in transverse cross-section greater than that of the insulation layers for opposing insulation-disruptive forces impacting said jacket and being sufficiently flexible for long-radius bending with the cable in a plane substantially perpendicular to a plane containing said longitudinal axes of said conductors.

* * * * *